US012557908B2

(12) United States Patent
Hanlon

(10) Patent No.: US 12,557,908 B2
(45) Date of Patent: Feb. 24, 2026

(54) STORAGE RACK

(71) Applicant: Perfect Site LLC, Las Vegas, NV (US)

(72) Inventor: Jared W. Hanlon, Las Vegas, NV (US)

(73) Assignee: Perfect Site LLC, Las Vegas, NV (US)

( * ) Notice: Subject to any disclaimer, the term of this patent is extended or adjusted under 35 U.S.C. 154(b) by 0 days.

(21) Appl. No.: 18/142,957

(22) Filed: May 3, 2023

(65) Prior Publication Data

US 2023/0270248 A1 Aug. 31, 2023

Related U.S. Application Data

(63) Continuation-in-part of application No. 17/476,337, filed on Sep. 15, 2021, now Pat. No. 11,647,833.

(60) Provisional application No. 63/338,336, filed on May 4, 2022, provisional application No. 63/079,443, filed on Sep. 16, 2020.

(51) Int. Cl.

| | |
|---|---|
| ***A47B 57/48*** | (2006.01) |
| ***A47B 47/00*** | (2006.01) |
| ***A47B 96/14*** | (2006.01) |
| *A47B 57/20* | (2006.01) |
| *A47B 57/22* | (2006.01) |
| *A47B 57/30* | (2006.01) |
| *A47B 57/50* | (2006.01) |

(52) U.S. Cl.

CPC ..... *A47B 57/482* (2013.01); *A47B 47/0083* (2013.01); *A47B 96/1441* (2013.01); *A47B 57/20* (2013.01); *A47B 57/22* (2013.01); *A47B 57/30* (2013.01); *A47B 57/50* (2013.01)

(58) Field of Classification Search

CPC ..... A47B 57/482; A47B 47/0083; A47B 96/1441; A47B 47/00; A47B 47/0041; A47B 47/021; A47B 47/027; A47B 47/045; A47B 57/06; A47B 57/16; A47B 57/20; A47B 57/22; A47B 57/30; A47B 57/40; A47B 57/50

See application file for complete search history.

(56) References Cited

U.S. PATENT DOCUMENTS

| | | | |
|---|---|---|---|
| 3,056,507 | A | 10/1962 | Squires, Jr. et al. |
| 3,285,428 | A | 11/1966 | Scheck |

(Continued)

FOREIGN PATENT DOCUMENTS

| | | |
|---|---|---|
| CN | 201064290 | 5/2008 |
| CN | 202381473 | 8/2012 |

(Continued)

*Primary Examiner* — Devin K Barnett

(74) *Attorney, Agent, or Firm* — Snell & Wilmer LLP

(57) ABSTRACT

A storage rack is provided. The storage rack includes a plurality of upright supports and a shelf support supported by each of the plurality of upright supports. The plurality of upright supports include a first upright support, a second upright support, a third upright support, and a fourth upright support each having an opening. The shelf support includes a shelf beam extending between the first and second upright supports. The shelf beam includes a body, a first tab, and a second tab. The first and second tabs each extend outwardly from an end of the body and are configured to engage the first upright support at opposing sides of the opening of the first upright support in order to detachably connect the shelf beam to the first upright support.

10 Claims, 12 Drawing Sheets

(56) References Cited

U.S. PATENT DOCUMENTS 3,305,255 A 2/1967 Roy et al.
3,741,405 A * 6/1973 McConnell ..... A47B 57/487 211/192
3,858,996 A 1/1975 Jarvis
3,862,691 A 1/1975 Mori et al.
3,871,525 A * 3/1975 Al-Dabbagh ..... A47B 57/402 211/206
4,101,233 A 7/1978 McConnell
4,165,698 A 8/1979 Ferdinand
4,197,952 A 4/1980 De Fouw
4,199,069 A 4/1980 Talarico
4,423,817 A 1/1984 Monjo-Rufi
4,545,490 A 10/1985 Hsiao et al.
4,549,665 A 10/1985 Smitley
4,645,276 A 2/1987 Flavigny
4,665,838 A 5/1987 Minshall
4,742,782 A 5/1988 Miller
4,773,547 A 9/1988 Bell
4,796,541 A 1/1989 Halstrick
4,996,929 A 3/1991 Saal
5,190,172 A 3/1993 Tyson
5,463,966 A 11/1995 Nilsson
5,553,549 A * 9/1996 Nilsson ..... A47B 9/00 108/147.11
5,628,415 A 5/1997 Mulholland
5,713,651 A 2/1998 Essig
6,273,281 B1 * 8/2001 Berglund ..... A47B 57/50 108/147.11
6,527,473 B2 3/2003 Chen
6,902,074 B2 6/2005 Albrecht
6,920,831 B2 7/2005 Lin
7,044,312 B2 * 5/2006 Yang ..... A47B 57/40 211/187
7,252,202 B2 * 8/2007 Saltzberg ..... A47B 57/50 211/187
D604,065 S 11/2009 Towater
7,810,770 B2 10/2010 Treadwell
8,292,093 B2 10/2012 Fan
8,292,380 B2 10/2012 Fan
8,443,992 B2 5/2013 Lawson et al.
D683,983 S 6/2013 Troyner et al.
8,585,313 B2 11/2013 Wojoetowicz et al.
8,632,272 B2 1/2014 Wojtowicz et al.
8,672,577 B2 3/2014 Wojtowicz et al.
8,695,816 B2 4/2014 Troyner et al.
8,714,864 B2 5/2014 Wojtowicz et al.
D708,051 S 7/2014 Wojtowicz et al.
8,967,401 B2 * 3/2015 Wu ..... A47B 47/0083 403/217
9,027,767 B2 5/2015 Buckley et al.
9,033,164 B2 5/2015 Troyner et al.
9,215,931 B1 * 12/2015 Offerman ..... A47B 96/024
9,232,858 B2 1/2016 Scholz
9,301,610 B1 4/2016 Berry
9,375,102 B2 * 6/2016 Troyner ..... A47F 5/01
9,386,855 B2 7/2016 Sabounjian
9,439,508 B2 9/2016 Wojtowicz et al.
9,474,369 B1 * 10/2016 Tsai ..... A47B 87/02
9,474,370 B2 10/2016 Troyner et al.
D777,479 S 1/2017 Anderson
9,661,921 B1 5/2017 Tsai
9,723,925 B1 8/2017 Tsai
D800,347 S 10/2017 Blick
9,961,995 B2 * 5/2018 Kam ..... A47B 47/028
9,993,075 B2 6/2018 Buckley et al.
9,999,303 B2 6/2018 Tan
10,238,208 B2 3/2019 Henonin
10,299,589 B1 5/2019 Lai
10,299,593 B2 5/2019 Bruckner
10,299,594 B2 5/2019 Liss et al.
D857,434 S * 8/2019 Liu ..... D6/712
10,376,047 B1 * 8/2019 Ebbesson ..... A47B 47/0083
10,389,092 B2 8/2019 Matsumoto
10,597,189 B2 3/2020 Gu
10,626,905 B1 * 4/2020 Chiu ..... A47B 57/545
10,694,849 B2 6/2020 Liss et al.
10,702,062 B2 * 7/2020 Lee ..... A47B 57/50
10,806,257 B1 10/2020 Liu
10,925,390 B2 2/2021 Reuter
D920,722 S * 6/2021 Li ..... D6/675.1
11,026,509 B2 6/2021 Walker
11,028,586 B2 6/2021 Iellimo
11,039,686 B2 * 6/2021 Min ..... A47B 47/0083
11,064,806 B1 * 7/2021 Ge ..... A47B 87/0207
11,083,289 B2 8/2021 Nemeth et al.
11,647,833 B2 * 5/2023 Hanlon ..... A47B 47/028 211/192
11,896,121 B2 * 2/2024 Globerman ..... A47B 57/50
11,925,258 B2 * 3/2024 Chakraborthy ..... A47B 96/07
11,992,120 B2 * 5/2024 Davis ..... A47B 57/34
D1,036,244 S * 7/2024 Beck ..... D8/381
12,114,771 B2 * 10/2024 Yoon ..... A47B 47/0083
D1,050,781 S * 11/2024 Chakraborthy ..... D6/705.5
D1,050,784 S * 11/2024 Chakraborthy ..... D6/712
12,161,221 B2 * 12/2024 Ge ..... A47B 57/265
D1,077,619 S * 6/2025 Wu ..... D6/712
2004/0177792 A1 * 9/2004 Salmanson ..... A47B 57/22 108/55.1
2004/0182810 A1 9/2004 Rosen
2005/0103733 A1 * 5/2005 Saltzberg ..... A47B 96/00 211/187
2005/0103734 A1 * 5/2005 Saltzberg ..... A47B 96/1441 211/187
2006/0144809 A1 7/2006 Collins et al.
2006/0163438 A1 7/2006 Wojotowicz et al.
2008/0145197 A1 6/2008 Taylor et al.
2011/0042336 A1 2/2011 Cheng
2011/0266239 A1 11/2011 Daily
2011/0272373 A1 * 11/2011 Wojtowicz ..... A47B 96/1458 248/218.4
2011/0272542 A1 * 11/2011 Wojtowicz ..... A47B 87/0215 248/218.4
2011/0272543 A1 * 11/2011 Wojtowicz ..... A47B 87/0215 248/218.4
2012/0000873 A1 * 1/2012 Fitzgerald ..... A47B 57/50 211/153
2012/0187065 A1 7/2012 Song
2012/0193314 A1 8/2012 Liao
2013/0098856 A1 4/2013 Troyner et al.
2014/0284294 A1 * 9/2014 Taylor ..... A47B 96/06 248/218.4
2015/0282613 A1 * 10/2015 Chen ..... A47B 96/021 211/187
2015/0313357 A1 * 11/2015 David ..... A47B 47/027 211/187
2017/0208950 A1 * 7/2017 Tsai ..... A47B 96/145
2017/0211604 A1 * 7/2017 Tsai ..... A47B 96/061
2017/0280875 A1 * 10/2017 Buckley ..... A47B 57/34
2018/0344031 A1 * 12/2018 Wang ..... B25H 3/04
2019/0029416 A1 * 1/2019 Lu ..... A47B 57/50
2019/0059588 A1 * 2/2019 Liss ..... A47B 96/1408
2019/0125077 A1 * 5/2019 Liss ..... A47B 47/027
2019/0239639 A1 8/2019 Brunner
2019/0290000 A1 * 9/2019 Davis ..... A47F 5/13
2019/0328134 A1 * 10/2019 Walker ..... A47B 96/1408
2020/0054126 A1 * 2/2020 Globerman ..... A47B 57/40
2020/0297113 A1 9/2020 Liss et al.
2020/0305596 A1 * 10/2020 Min ..... A47B 96/068
2021/0030149 A1 2/2021 Carrasco Lopez
2021/0337964 A1 * 11/2021 Williams ..... A47B 57/34
2022/0079338 A1 * 3/2022 Hanlon ..... A47B 47/028
2022/0338621 A1 * 10/2022 Han ..... A47B 47/0041
2023/0129296 A1 * 4/2023 Chakraborthy .... A47B 47/0083 211/134
2023/0276941 A1 * 9/2023 Hanlon ..... A47B 47/028 211/192
2023/0363530 A1 * 11/2023 Yoon ..... A47B 96/1441
2023/0398678 A1 * 12/2023 Hanlon ..... B25H 3/04

(56) References Cited

U.S. PATENT DOCUMENTS

FOREIGN PATENT DOCUMENTS

| | | |
|---|---|---|
| CN | 204908538 | 12/2015 |
| CN | 109043911 | 12/2018 |
| CN | 105864242 | 1/2019 |
| CN | 209106621 | 7/2019 |
| CN | 209862877 | 12/2019 |
| CN | 212678648 | 3/2021 |
| CN | 213075023 | 4/2021 |
| DE | 4314682 | 11/1994 |
| DE | 29808396 | 8/1998 |
| DE | 202006008038 | 10/2006 |
| EP | 0808589 | 7/2003 |
| GB | 570503 | 7/1945 |
| GB | 2368469 | 11/2003 |
| GB | 24866640 | 4/2014 |
| KR | 20-0320245 | 7/2003 |
| KR | 200473792 | 8/2014 |
| KR | 20210115689 | 11/2021 |
| RU | 2723362 | 6/2020 |
| WO | 200053056 | 9/2000 |
| WO | 2019033287 | 2/2019 |
| WO | 2020062196 | 4/2020 |

* cited by examiner

STORAGE RACK

RELATED APPLICATION DATA

This application claims priority to U.S. application Ser. No. 63/338,336, filed May 4, 2022, and is a continuation-in-part of U.S. application Ser. No. 17/476,337, filed Sep. 15, 2021, which claims priority to U.S. Provisional Application Ser. No. 63/079,443, filed Sep. 16, 2020, which applications are incorporated herein in their entirety by reference.

FIELD OF THE INVENTION

The present invention relates to storage racks and shelving units.

BACKGROUND OF THE INVENTION

A variety of workbenches, storage racks and similar structures are known, such as for use in a garage or workshop for supporting tools and workpieces. Despite the number of such existing products, a need still exists for improvements to such products.

One problem is that these products are generally manufactured as a plurality of components and are then packaged and shipped in an unassembled configuration to the user or to a store at which the user purchases the product. There is a high costs associated with shipping and storing the products, part of which is based upon the size of the packaging. It is thus desirable to innovate new structures which perform the desired functionality in use, but which can be packed or packaged to a minimal amount of space. Also, because the end user generally must assemble the product, it is at the same time desirable that the assembly process be user-friendly. Another problem is that it is desirable for these products to be more robust when assembled.

It is with respect to these and other considerations that the instant disclosure is concerned.

SUMMARY OF THE INVENTION

In one aspect of the disclosed concept, a storage rack is provided. The storage rack includes a plurality of upright supports and a shelf support supported by each of the plurality of upright supports. The plurality of upright supports include a first upright support, a second upright support, a third upright support, and a fourth upright support each having an opening. The shelf support includes a shelf beam extending between the first and second upright supports. The shelf beam includes a body, a first tab, and a second tab. The first and second tabs each extend outwardly from an end of the body and are configured to engage the first upright support at opposing sides of the opening of the first upright support in order to detachably connect the shelf beam to the first upright support.

In another aspect of the disclosed concept, a storage rack comprises a plurality of upright supports comprising a first upright support, a second upright support, a third upright support, and a fourth upright support; a shelf support supported by each of the plurality of upright supports, the shelf support comprising: a first shelf beam extending between the first and second upright supports, a second shelf beam extending between the third and fourth upright supports, and a cross-beam extending between the first and second shelf beams in order to support the shelf support between ends and sides thereof; and a clip coupled to the cross-beam, the clip comprising a biasing element and a pair of pins extending from and being biased by the biasing element, each of the pair of pins being configured to extend through the first shelf beam in order to couple the cross-beam to the first shelf beam.

In yet another aspect of the disclosed concept, a packaging kit for assembly into a storage rack is provided. The packaging kit comprises a plurality of assembly sets each comprising: a cross-beam, a shelf beam nested within the cross-beam, and a pair of upright supports each positioned such that the cross-beam and the shelf beam are nested within the pair of upright supports. The plurality of assembly sets are positioned side by side such that one of the pair of upright supports of a first of the plurality of assembly sets engages one of the pair of upright supports of a second of the plurality of assembly sets.

Further objects, features, and advantages of the present invention over the prior art will become apparent from the detailed description of the drawings which follows, when considered with the attached figures.

DETAILED DESCRIPTION OF THE INVENTION

As employed herein, the term "coupled" shall mean connected together either directly or via one or more intermediate parts or components.

As employed herein, the term "number" shall mean one or an integer greater than one (i.e., a plurality).

In the following description, numerous specific details are set forth in order to provide a more thorough description of the present invention. It will be apparent, however, to one skilled in the art, that the present invention may be practiced without these specific details. In other instances, well-known features have not been described in detail so as not to obscure the invention.

One embodiment of the invention is an improved storage rack and features of such a rack, which features may be utilized relative to other products or devices, such as workbenches, shelving units and the like. Additional aspects of the invention comprise methods of making, methods of packing (in an unassembled or partially unassembled configuration) and methods of assembling, a rack.

Figure 1A:
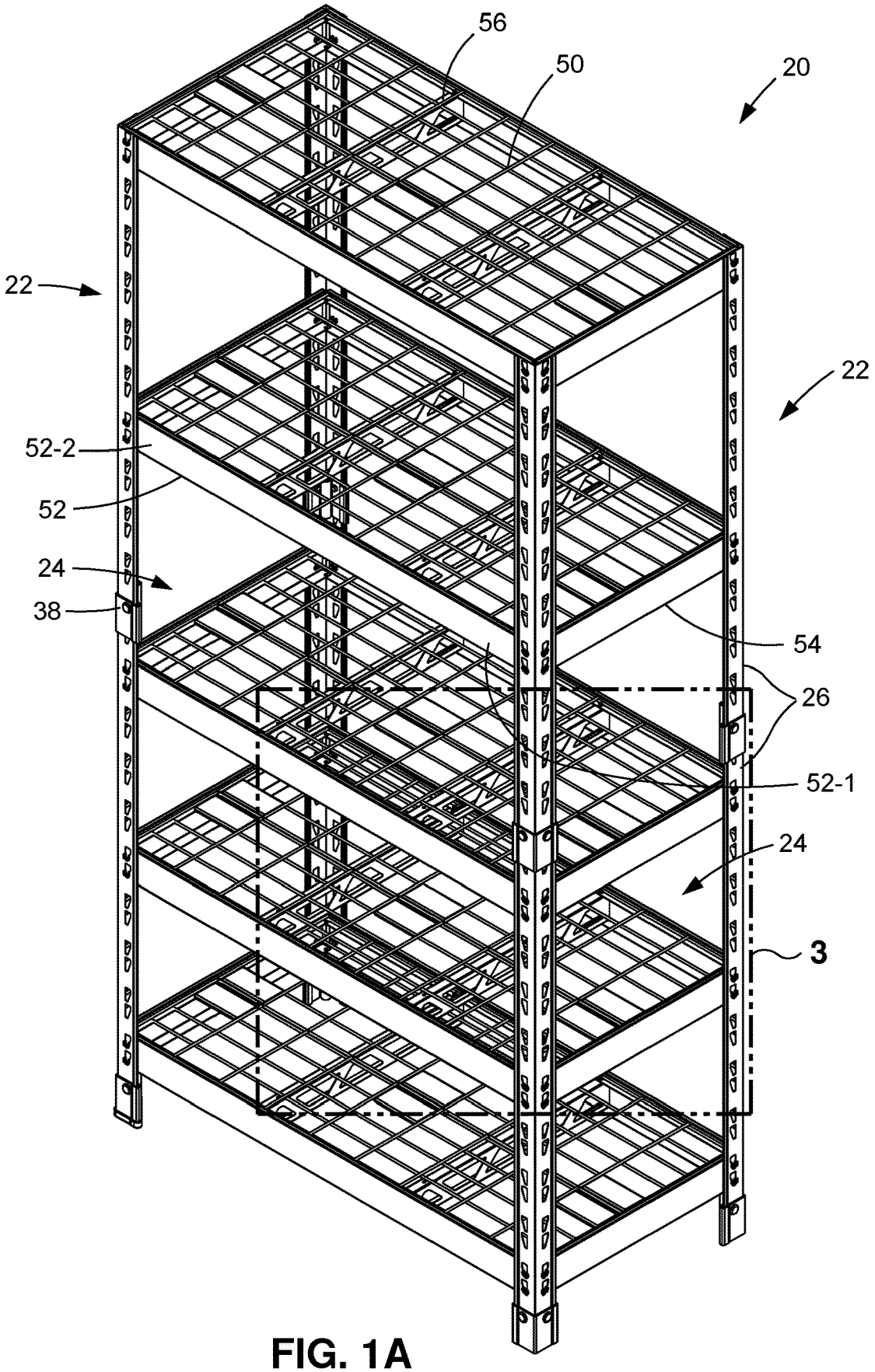
FIG. 1A is an isometric view of a storage rack, in an assembled configuration, according to one non-limiting embodiment of the disclosed concept.

FIG. 1A illustrates a storage rack 20 in one assembled configuration in accordance with an embodiment of the invention. In general, the storage rack 20 comprises a plurality of upright supports 22 which support a plurality of shelves 24. In the configuration illustrated, four upright supports 22 are provided, such as at corners of the assembled rack 20. In this configuration, the rack 20 generally has a pair of opposing ends, and a front and a generally opposing back or rear.

The upright supports 22 might comprise a single elongate support. However, to facilitate reduced dimension packaging and shipping, each upright support 22 may comprise a plurality of shorter upright sections 26 which are connected to one another. The number of upright sections 26, including their length, may be chosen based upon a desired height of the rack 20. In one embodiment, for example, the upright supports 22 may comprise two upright sections 26.

Figure 2:
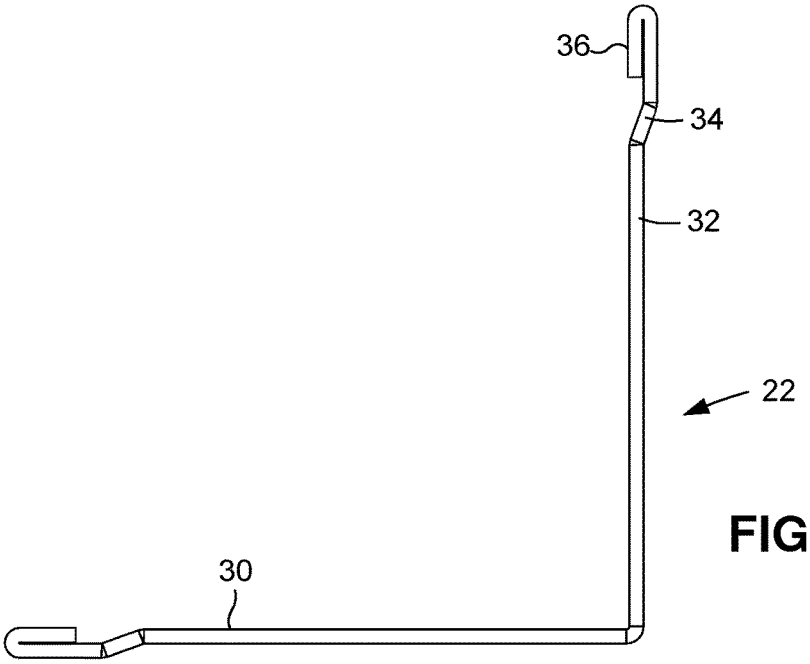
FIG. 2 is top view of an upright support for the storage rack according to FIG. 1A.

As illustrated in FIG. 2, in one embodiment, the upright supports 22 may have a generally "L" shaped cross-section, such as having a first leg 30 and a second leg 32 which are connected to one another at generally a 90 degree angle. Each leg 30,32 has a free end. Most importantly, the free end of each leg 30,32 has an offset 34. This offset 34 results in the end portion of the leg protruding outwardly, preferably by a distance equal to approximately the thickness of the leg. This offset 34 allows a folded or bent end 36 of the free end of each leg 30,32 (which extends backwardly towards the first end of the leg) to have a face which is co-planar with a face of the remaining portion of the leg (preferably at the inside or rear of the upright support 22).

Figure 3:
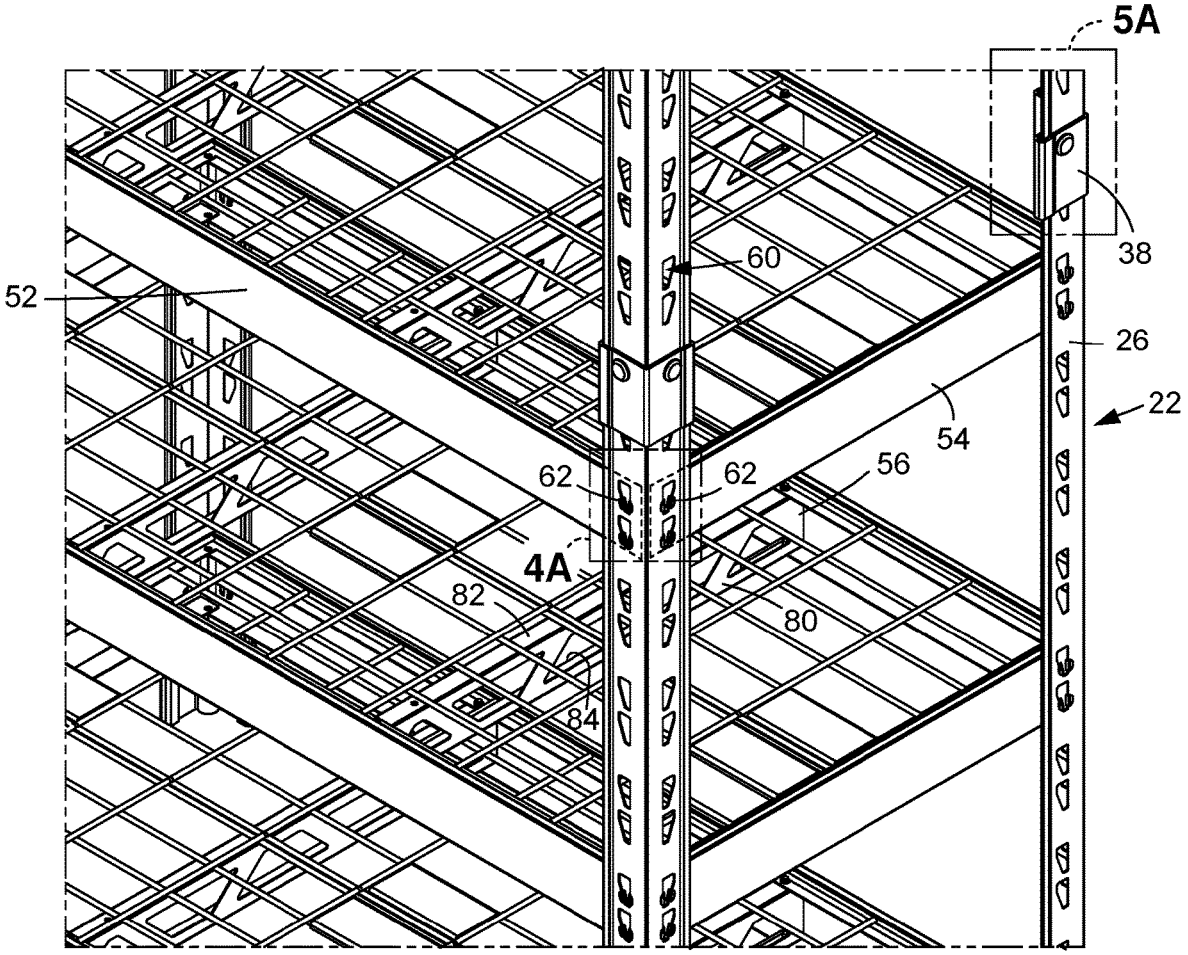
FIG. 3 is an enlarged view of a portion of the storage rack according to FIG. 1A.
Figure 5A:
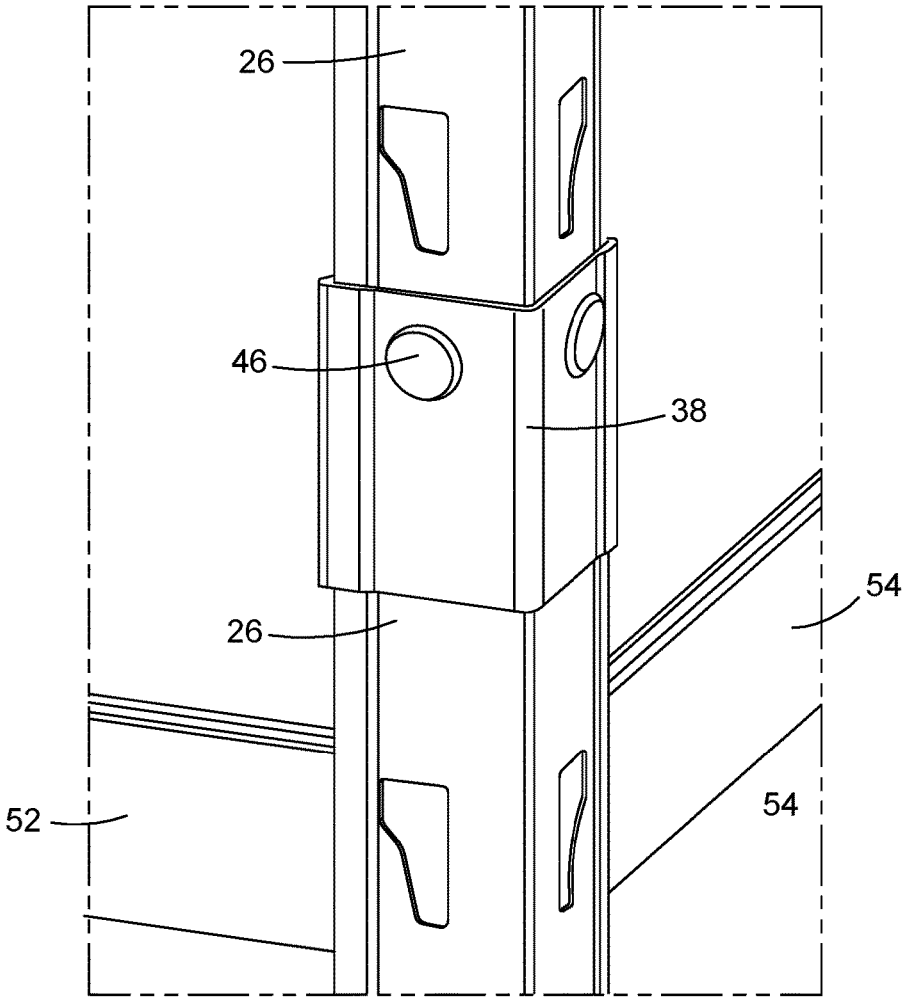
FIG. 5A is an enlarged view of a portion of the storage rack of FIG. 3.
Figure 5B:
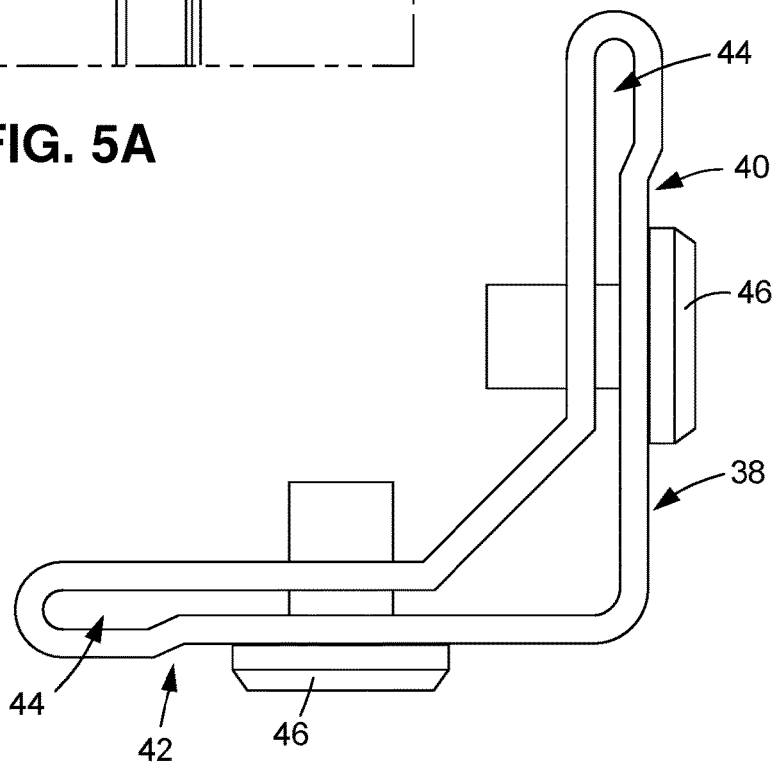
FIG. 5B is a top view of a sleeve for the portion of FIG. 5A.

As illustrated in FIGS. 1, 3, and 5A, the upright sections 26 may be connected with a sleeve or connector 38. As illustrated in FIGS. 5A and 5B, the sleeve 38 may be generally "L" shaped in cross-section, having a pair of legs 40,42 which extend outwardly generally perpendicular to one another. The each leg 40,42 may define a slot 44, whereby the sleeve 38 is generally enclosed and may be slipped over the similarly shaped upright section 26 so that it fits into the sleeve 38, such as with the legs 30,32 of the upright section 26 located in the respective slots 44 of the legs 40,42 of the sleeve 38. The sleeve 38 may be extruded (preferably of aluminum). The closed configuration of the sleeve 38 has a number of advantages, including that it can engage the entirely of the exterior surface of an upright section 26.

As illustrated in FIG. 5A, the sleeve 38 may be connected to one or more upright sections 26. In one embodiment, the sleeve 38 might be removably connected, such as either simply slid onto the upright sections or may be connected thereto with a removable fastener or the like. In another embodiment, the sleeve 38 might be fixedly connected to one of the upright sections 26, such as at an end of the upright section 26, such as via a rivet 46. This secures the sleeve 38 to one of the upright sections 26, thus preventing it from becoming disconnected, lost, mis-aligned or the like. The user may then insert an end of another upright section 26 into the opposing portion of the sleeve 38. In one configuration, for example, the sleeve 38 is connected to a top end of a lower upright section 26 and a bottom end of an upper upright section 26 is then inserted into the top of the sleeve 38 so that the upper upright section 26 extends upwardly beyond the lower upright section. This process/configuration may be repeated to make the rack 20 even taller, such as by having a sleeve located on the top end of the upper upright section 26 which can then accept the bottom end of a third upright section 26, etc.

Referring again to FIG. 1A, as indicated above, the rack 20 may include a plurality of shelves 24. In one embodiment, the shelves 24 comprise one or more decks 50, such as supported by one or more shelf supports which are themselves supported by the upright supports 22. In one embodiment, the shelf supports comprise one or more shelf beams 52, one or more end beams 54, and as described below, one or more shelf cross-beams 56. As illustrated, the shelf beams 52 may extend between upright supports 22 at the front and rear of the rack 20, and the end beams 54 may extend between the pairs of upright supports 22 at each end of the rack 20.

Preferably, the shelf beams 52 and the end beams 54 are configured to detachably connect to the upright supports 22. As illustrated in FIG. 3, in one embodiment, the upright supports 22 each preferably have a plurality of spaced openings 60, such as in each leg 30,32 (FIG. 2) thereof. The openings 60 may be generally inverted triangular in shape, having a larger dimension at the top than at the bottom (such as a having a generally horizontal top and two sides which extend downwardly and angle towards one another or where, as illustrated, one side of the opening is generally vertical or straight, and the other side is angled relative thereto), the purpose of which will be more apparent below.

Figure 4A:
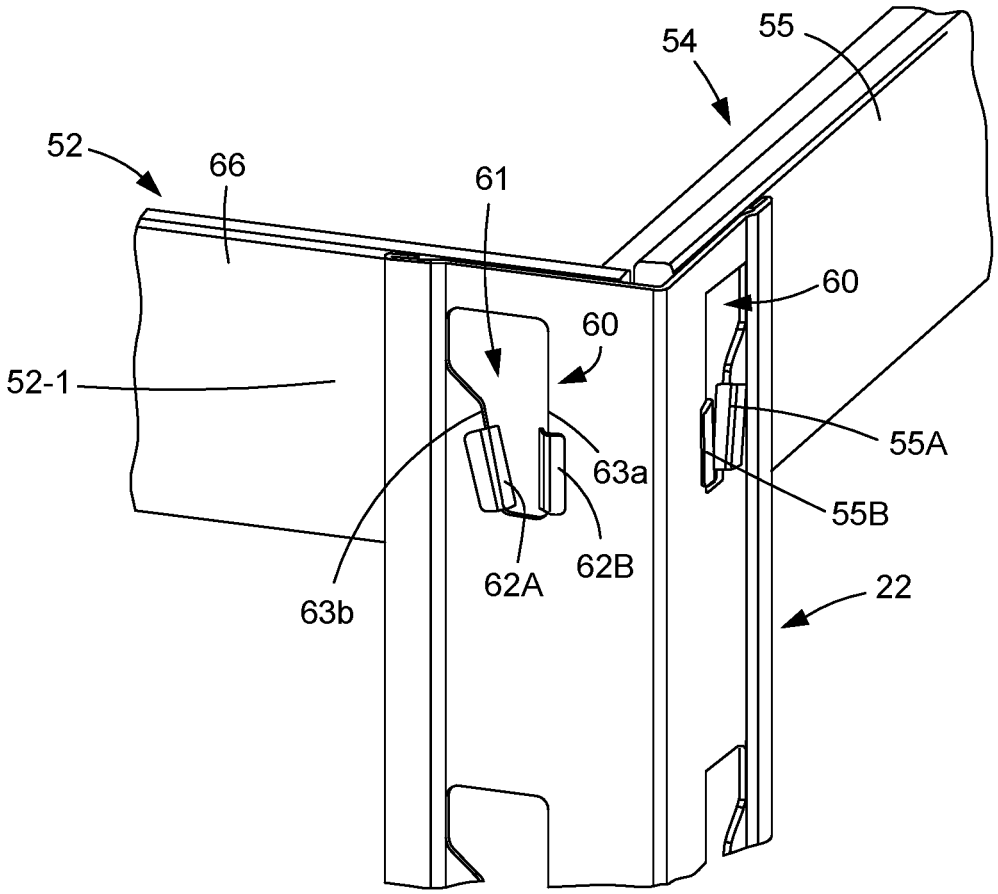
FIG. 4A is an enlarged view of a portion of the storage rack according to FIG. 3.
Figure 4B:
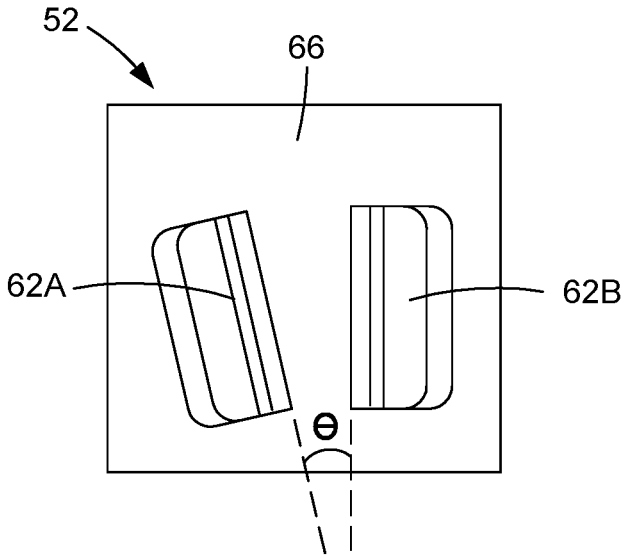
FIG. 4B is a front view of a portion of the shelf beam of FIG. 4A.

FIG. 4A shows an enlarged view of a portion of the storage rack of FIG. 3, and FIG. 4B shows a front view of a portion of the shelf beam 52 of FIG. 4A. As shown in FIG. 4A, the shelf beam 52 may include a body or face 66, a first tab 62A and a second tab 62B each extending outwardly from an end 52-1 of the body 66 and configured to engage the upright support 22 at opposing sides of the opening 60 of the upright support 22 in order to detachably connect the shelf beam 52 to the upright support 22. In one example, first and second tabs also extend outwardly from a second end 52-2 (FIG. 1A) of the shelf beam 52 to detachably connect the shelf beam 52 to another upright support 22.

As shown in FIG. 4B, the first tab 62A may be located at an angle θ of between 5 degrees and 20 degrees with respect to the second tab 62B, in order for the first and second tabs 62A,62B to engage the upright support 22 in a wedging fashion. In one example, the second tab 62B is elongated in a direction parallel to the upright support 22, and the first tab 62A is angled with respect to an axis of the upright support 22 (e.g., at an angle of between 5 degrees and 20 degrees). In this configuration, the width of the opening 60 that top is wider than the bottom, thus allowing the user to easily pass the tabs 62A,62B into an enlarge portion 61 of the opening 60 and the top, and to then move them downwardly to the narrower bottom (such as defined by a generally vertical first side 63*a* and a second side 63*b* which angles relative thereto) until then are wedged into position. This wedging effect is bolstered when items are placed on the associate shelf, whereby the mass thereof further presses the tabs 62A,62B downwardly, reducing the possibility that the shelf beam 52 might detach from the upright support 22.

Continuing to refer to FIG. 4A, the end beam 54 is also provided with a body 55, and first and second tabs 55A,55B extending outwardly from an end of the body 55 of the end beam 54. It will be appreciated that the first and second tabs 55A,55B of the end beam 54 are configured to engage another opening of the upright support 22 in the same manner as the tabs 62A,62B of the shelf beam 52. It will also be appreciated that the beams 52,54 have similarly configured tabs at opposing ends (e.g., each have third and fourth tabs similarly angled with respect to each other), and the other beams 52,54 of the storage rack 20 similarly have tabs at each end which are configured to engage openings of each of the four upright supports 22 in a wedging fashion, thereby allowing the beams 52,54 to be detachably connected to the four upright supports 22 in a relatively stable and reliable manner. The wedging connection between the tabs 55A, 55B, 62A, 62B and the openings 60 of the upright supports also aids in preventing rocking of the rack 20.

Figure 4C:
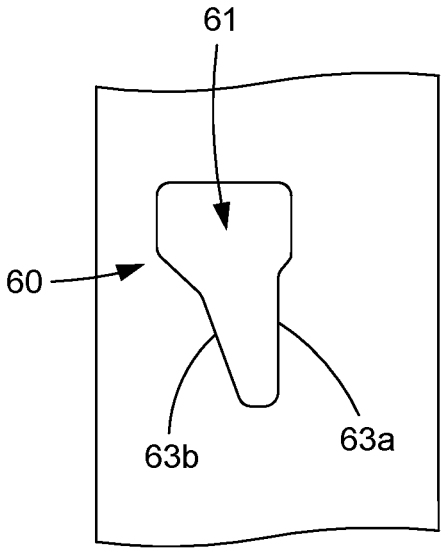
FIG. 4C illustrates a portion of the storage rack in accordance with another embodiment.

FIG. 4C illustrates another variation of an opening 60 for a shelf beam 52. This opening 60 is similar in shape to the one illustrated in FIG. 4A, except that the larger top portion 61 of the opening extends to either side of the narrower wedging portion there below which is defined by the first and second sides 63*a*,63*b*.

In one embodiment, the tabs 55A, 55B, 62A, 62B (e.g., and the other tabs of all the beams 52,54) may be punched from the beams. The tabs 55A, 55B, 62A, 62B may be generally "L" shaped, such as having a portion extending outwardly generally perpendicular to the beam and then an end portion which is bent, such as extending generally parallel to the beam.

As illustrated, a plurality of sets of openings 60 (at each leg of the upright support 22) may be defined along the length of the upright support 22, thus permitting the shelf supports to be placed in different positions (at different heights) relative to the upright supports 22.

Figure 6:
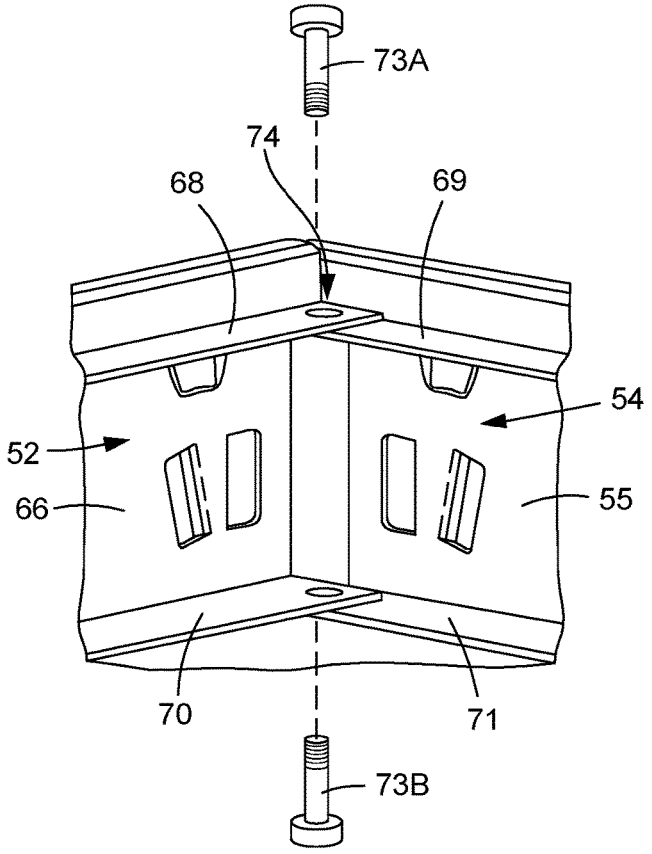
FIG. 6 is a partially exploded isometric view of an interior of a portion of the storage rack of FIG. 1A.

FIG. 6 illustrates one embodiment of an intersection of a shelf beam 52 and an end beam 54. In one configuration, both the shelf beam 52 and end beam 54 include at least one, and preferably two, inwardly extending flanges. In one embodiment, top or upper flanges 68,69 and bottom or lower flanges 70,71 each extend outwardly (e.g., without limitation, perpendicularly outwardly) from the rear of the bodies 55,66 of the beams 52,54. These flanges 68,69 and 70,71 preferably extend the length of the beams 52,54, but might only extend a partial distance, such as near the ends.

Accordingly, as illustrated in FIG. 6, when an end of a shelf beam 52 and an end of an end beam 54 are connected to the same upright support 22, the top flanges 68,69 and bottom flanges 70,71 thereof preferably overlap at the intersection thereof (at the corner defined by the upright support 22). In one embodiment, mating apertures 74 may be formed in the top and/or bottom flanges 68,70. Pins or other fasteners 73A,73B may be passed therethrough, in order to join the shelf beam 52 and the end beam 54 to one another. Other means for connecting might be used to directly join the shelf beam 52 and end beam 54 to one another in that overlapping area.

Figure 1B:
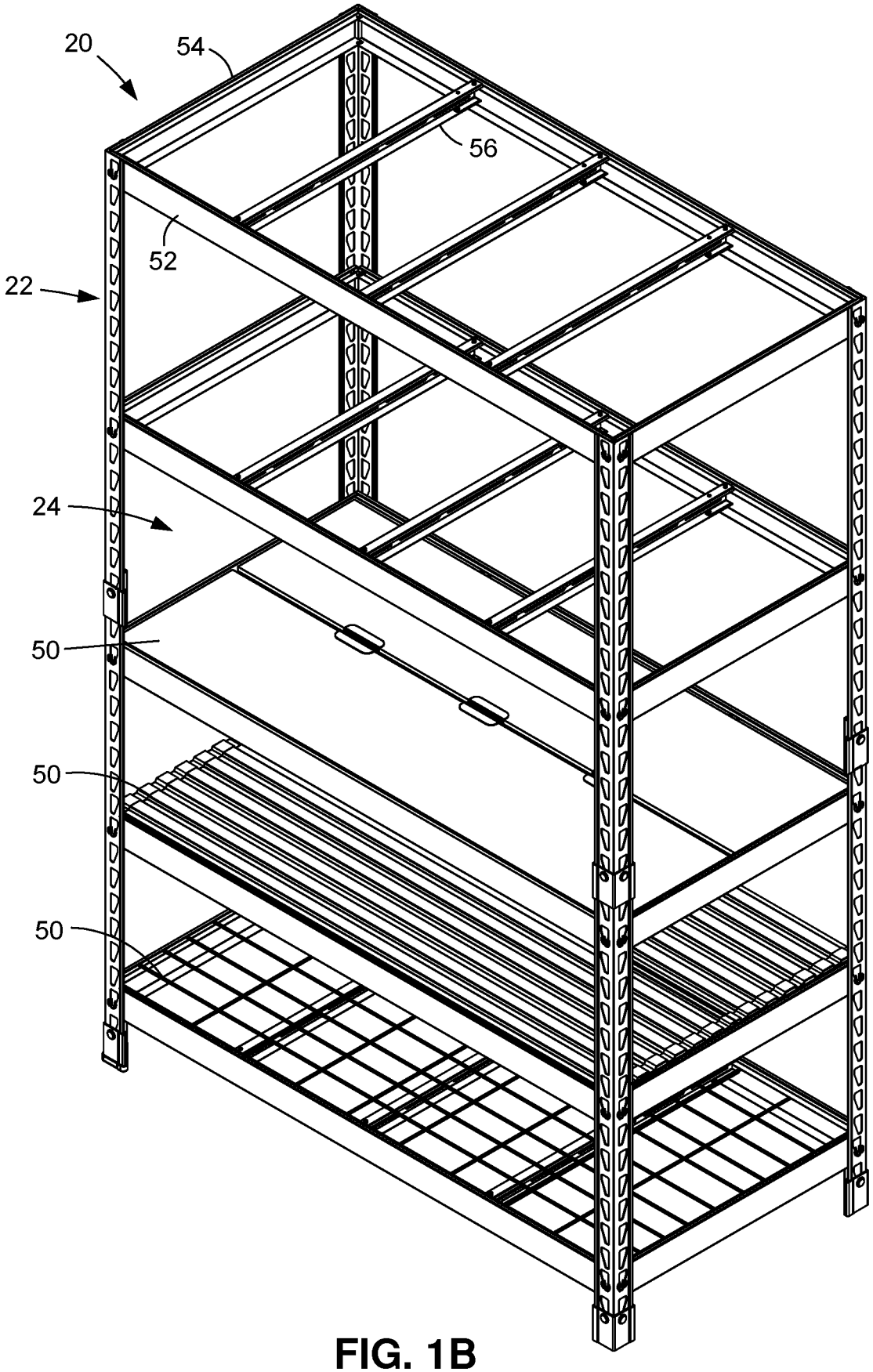
FIG. 1B shows an isometric view of the storage rack of FIG. 1A, shown with different decks in place of some of the wire decks that are shown in FIG. 1A.

The top flanges 68,69 of the shelf beams 52 and end beams 54 advantageously form an inset support (below a top edge of the face of the beam) for accepting, and supporting, a shelf deck 50. As illustrated in FIG. 1A, such a deck 50 may comprise a wire deck. However, as illustrated in FIG. 1B, the deck 50 might comprise a solid deck or partially solid deck, such as constructed from MDF, corrugated steel or combinations thereof. In some embodiments, the deck 50 may comprise more than one portion, such as to limit the dimension of the deck 50 for packaging and shipping (for example, the deck 50 might comprise two portions which are hingedly connected, thus permitting the portions to be folded onto one another, effectively halving the total dimension of the deck in at least one direction for packaging and shipping). In one preferred embodiment, the deck 50 may comprise thin-panel hardboard, such as high-density fiberboard (HDF), as such may reduce the deck weight by as much as 50% as compared to traditional steel decking. In such a configuration, the HDF decking 50 may be supported between the end beams 54 by one or more cross-beams (described in more detail below), to prevent flexing and cracking thereof under high load.

As indicated above and illustrated in FIGS. 1 and 3, the deck 50 may further be supported by one or more cross-beams 56. The cross-beams 56 may extend between shelf beams 52 located at the front and back of the rack 20, thus supporting the deck 50 between the ends and sides thereof. The number of cross-beams 56 may vary, such as based upon a size of the rack 20 (such as a width thereof from end to end). As illustrated, two spaced cross-beams 56 may be provided for each shelf 24.

Figure 11A:
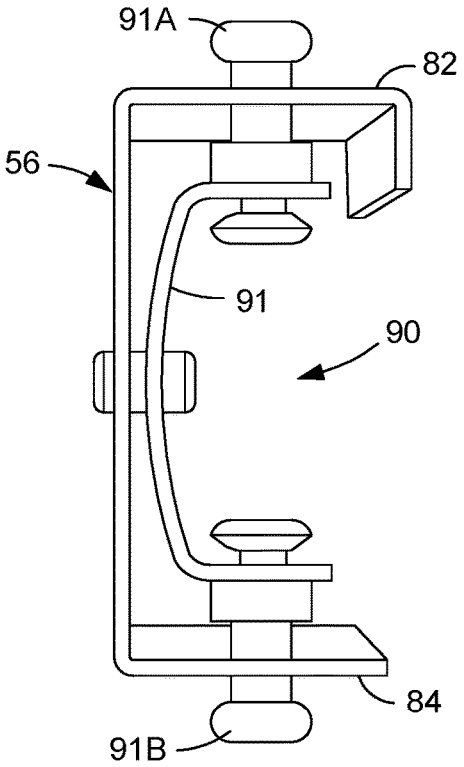
FIG. 11A is a side view of a cross-beam and clip for the storage rack according to FIG. 1A.
Figure 11B:
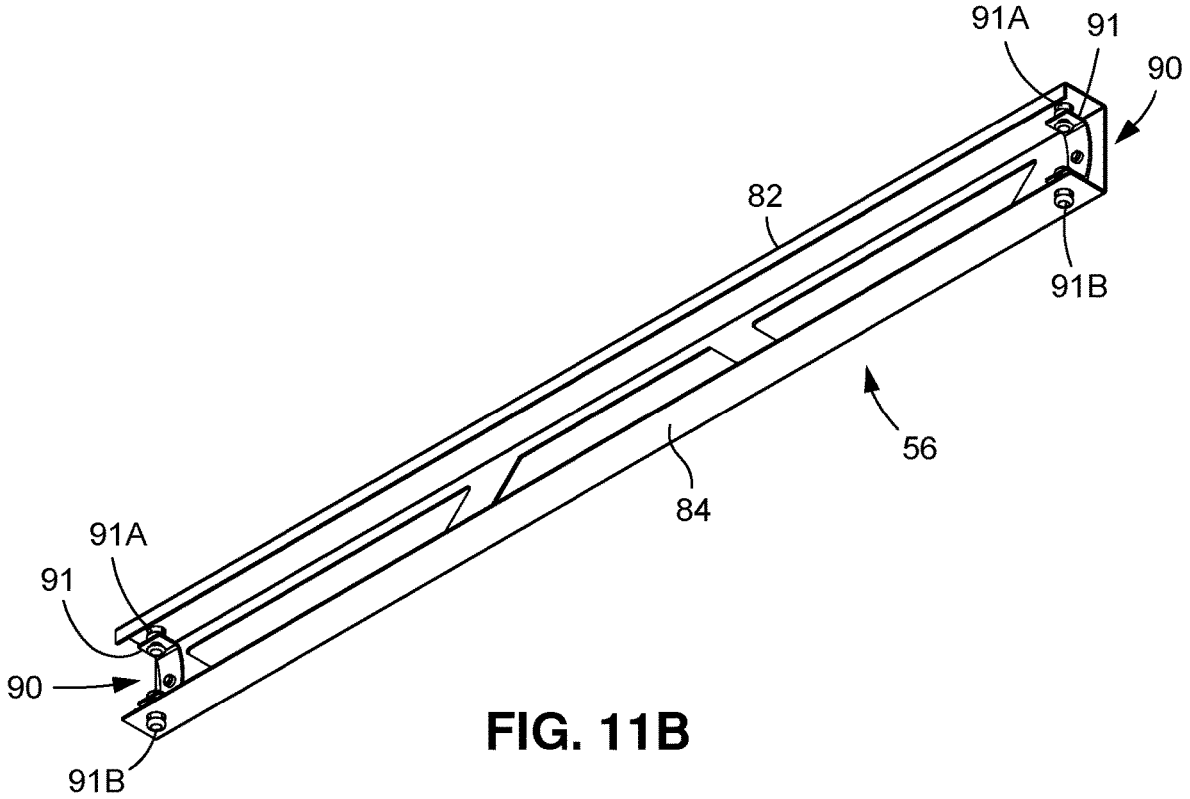
FIG. 11B is a rear isometric view of the cross-beam and clip therefor of FIG. 11A.
Figure 11C:
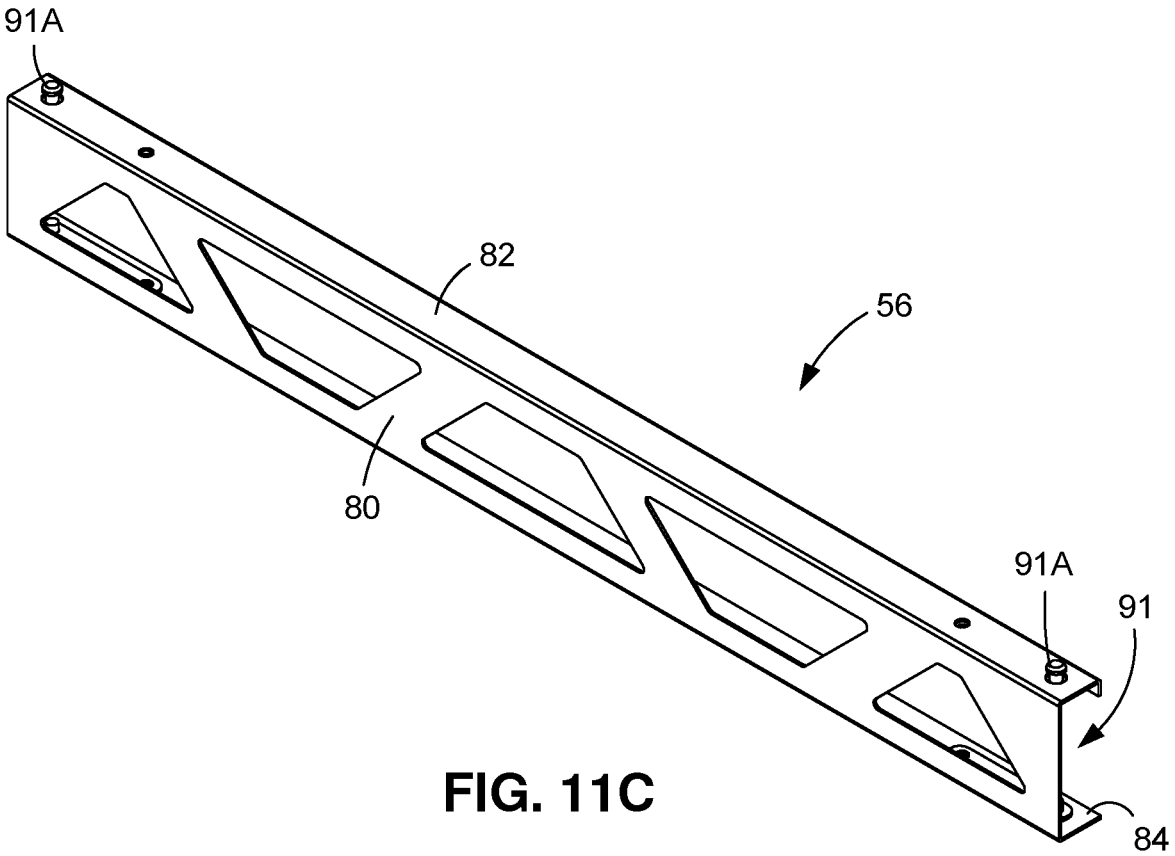
FIG. 11C is a front isometric view of the cross-beam and clip therefor of FIG. 11A.

As illustrated in FIGS. 3 and 11C, the cross-beams 56 may have a face or body 80, a top flange 82 which extends outwardly from a top portion of the face or body 80 in a first direction, and a bottom flange 84 which extends outwardly from a bottom portion of the face or body 80, preferably in the same direction as the top flange 82. In one embodiment, the face or body 80 may have a plurality of openings therein, such as for reducing the weight of the cross-beam 56. As illustrated in FIG. 3, opposing ends of the cross-beam 56 are configured to be located between the top and bottom flanges 68,70 of the shelf beams 52 when the cross-beam 56 is positioned for use.

Figure 7A:
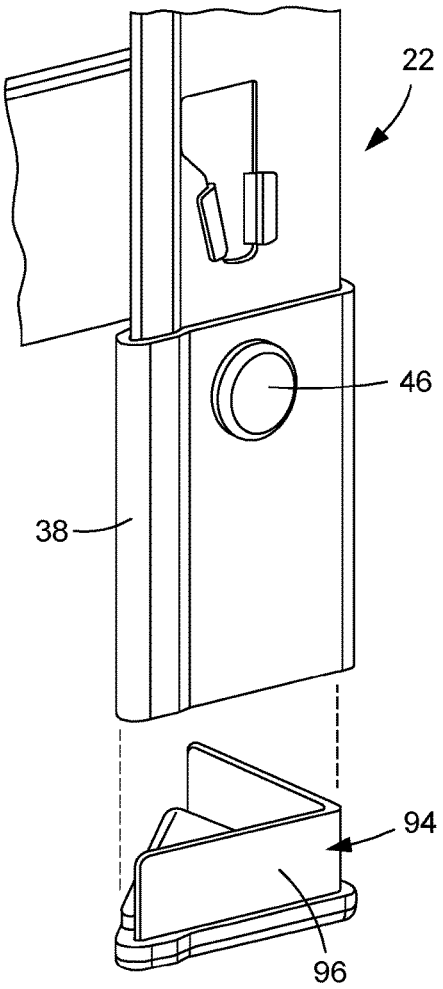
FIG. 7A is an isometric view of a bottom portion of the storage rack of FIG. 1A, shown with a base member exploded.

In accordance with the disclosed concept, the rack 20 may also have other features. For example, as illustrated in FIG. 7A, a base member (e.g., foot 94) may be provided at (such as connected to) the bottom of each upright support 22. In one preferred configuration, the foot 94 is configured to connect to the upright support 22 via one of the sleeves 38, such that the sleeve 38 may be located at the bottom of the upright support 26, and be fixedly connected to the bottom of the upright support 22 via a rivet 46. The foot 94 may have an upwardly extending flange 96 that is configured to fit within the sleeve 38, in order for the foot 94 to connect to the upright support 22.

Figure 7B:
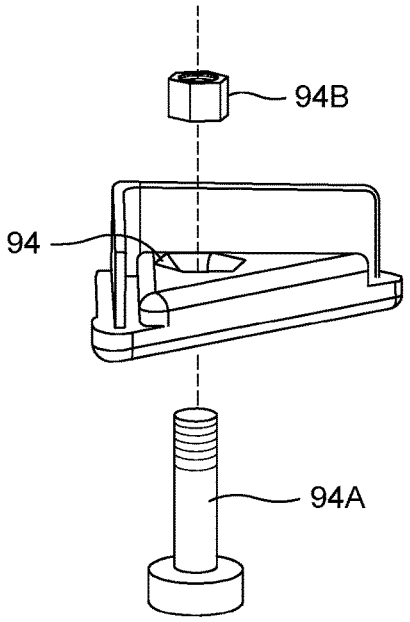
FIG. 7B is an exploded isometric view of the base member of FIG. 7A, shown with coupling members.

In another example, as shown in FIG. 7B, the foot 94 might support an adjustable pad 94A, such as which has a bottom portion for engaging a surface and a threaded top portion which engages a nut 94B that is associated with the foot 94, whereby rotation of the pad 94A causes it to move inwardly and outwardly from the foot 94 to raise or lower the upright support 22, such as to level the rack on an uneven surface.

Figure 8A:
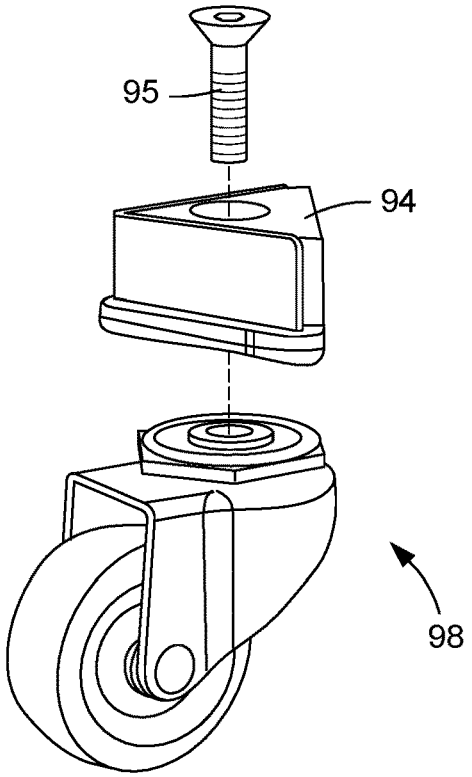
FIG. 8A is an exploded isometric view of the base member of FIG. 7A, shown with a wheel.

The foot 94 may be configured to accept a wheel or caster 98, as shown in FIG. 8A, thus permitting the rack 20 to be rolled. For example, the foot 94 may include a base portion which defines a mount, such as an opening for accepting a stud or fastener 95 which connects the wheel or caster 98 to the foot 94, via the mount of the foot 94 receiving the stud 95. In this manner, the storage rack 20 may be rolled on a surface. The caster 98 might be removable, such as to permit the user to either non-rollably support the rack 20 or rollably support the rack.

Figure 8B:
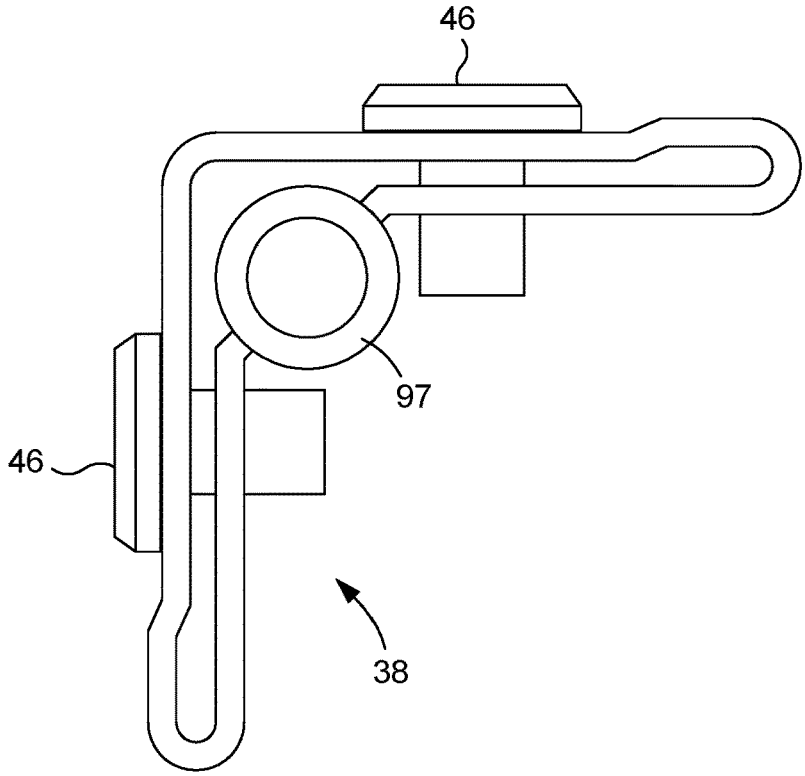
FIG. 8B illustrates another embodiment of a base member.

Alternatively, as illustrated in FIG. 8B, a wheel, caster or other element might be connected to a sleeve 38 which is located at or mounted to the bottom of the upright support 22. Such a sleeve 38 might be modified to include a stud mount 97, such as through which a stud of a foot, caster or the like might be placed and then connected to a nut, or where the interior of the stud mount 97 is threaded to engage threads of a caster, foot of the like.

Figure 9:
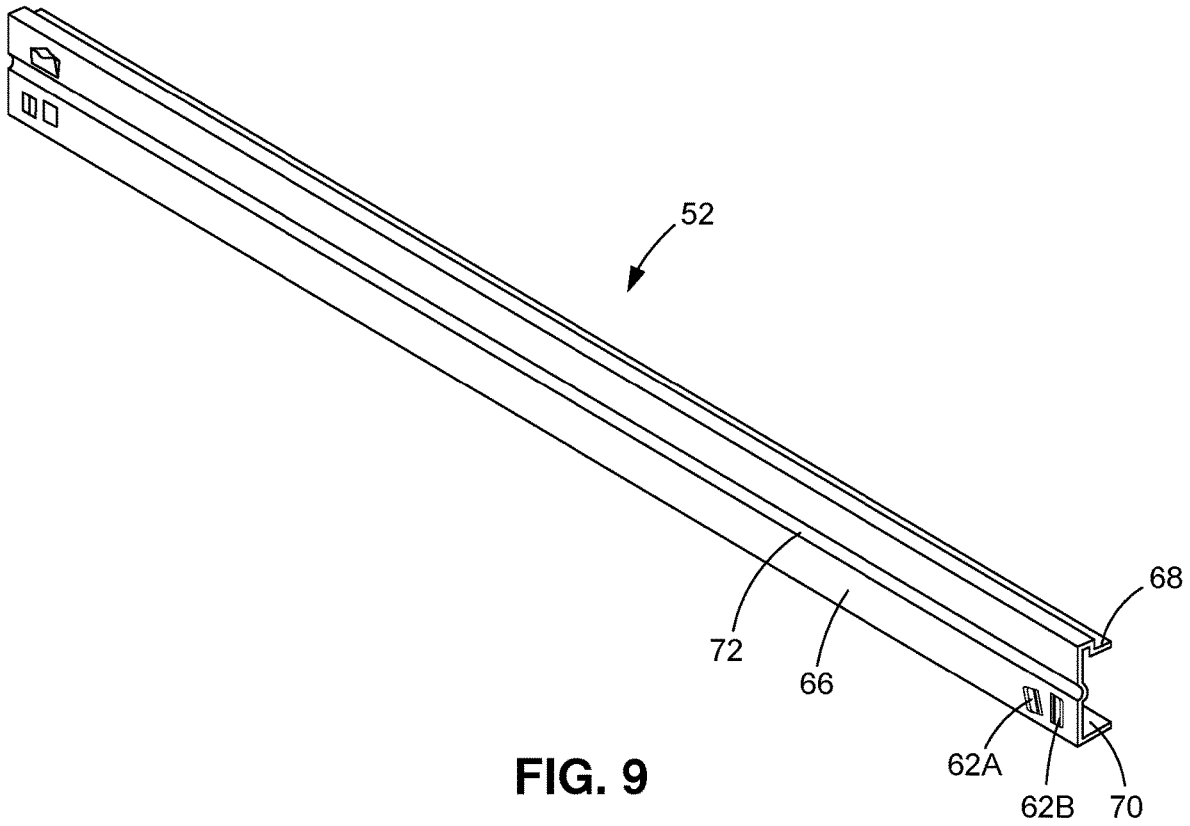
FIG. 9 is an isometric view of a shelf beam for the storage rack of FIG. 1A.
Figure 10:
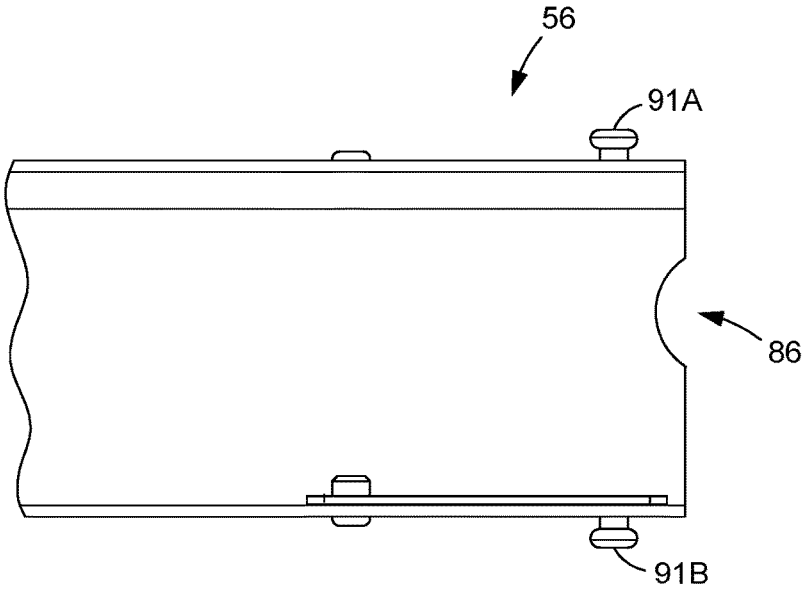
FIG. 10 is a front view of a portion of a cross-beam, shown with a portion of a clip, for the storage rack of FIG. 1A.

Referring to FIG. 9, the body 66 of the shelf beam 52 may define a rib or detent 72, such as extending along the length of the shelf beam 52 (in a directional parallel thereto) between its top and bottom (thus adding rigidity to the shelf beam 52). This rib or detent 72 may extend into the front of the shelf beam 52, and thus away from the back of the shelf beam 52. Additionally, as illustrated in FIG. 10, a notch 86 may be formed in each end of the cross-beam 56. This notch 86 accepts the rib 72 which extends outwardly at the rear of the shelf beam 52, thus allowing the remaining portions of the end of the cross-beam 56 to abut the rear of the face 66 of the shelf beam 52, and allowing the cross-beam 56 to be maintained on the shelf beam 52. In another example (not shown), a rib may be formed in the cross-beam and a notch may be formed in the shelf beam to accept the rib of the cross-beam.

In one embodiment, means may be provided for connecting the cross-beams 56 to the shelf beams 52, such as to prevent them from disconnecting from therefrom during use of the rack 20. In one embodiment, such as illustrated in FIGS. 11A-11C, a clip 90 may be used to couple the cross-beam 56 to the shelf beam 52. The clip 90 may have different configurations, such as comprising a biasing element 91 (such as a C shaped biased body or the like) and one or more pins or connectors 91A,91B which are then biased by the biasing element 91. In one example, the pins 91A,91B are each movable about a common longitudinal axis, such that during installation, the pins 91A,91B move toward each other, and then away from each other in order to lock elements in place. The pins or connectors 91A,91B may be configured to extend into or through mating openings in the top and bottom flanges 68,70 of the shelf beam 52 (e.g., after also passing through the top and bottom flanges 82,84 of the cross-beam 56). Accordingly, the cross-beam 56 is located between the top and bottom flanges 68,70 of the shelf beams 52, and is secured in place via the clip 90. The clips 90 might be attached to the cross-beams 56 or be separate therefrom. While the clip 90 may include a C shaped biasing member where the pins 91A,91B are located at each end and thus biased by the same member, in other embodiments, coil springs or the like might be associated with each pin 91A,91B, such as located between the pins and the cross-beam 56 in order to bias the pins outwardly, but permit them to be compressed towards the cross-beam 56 when the cross-member is being inserted into a shelf beam 52.

Figure 12:
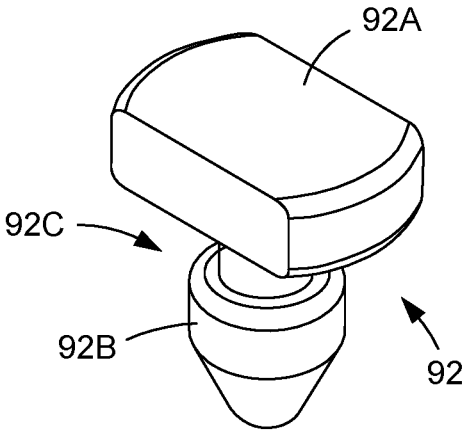
FIG. 12 is a front isometric view of a pin for use in connecting a shelf beam to a cross-beam, for the storage rack of FIG. 1A.

In another embodiment, as illustrated in FIG. 12, the connectors might comprise pins 92. These pins 92 may have a unique configuration for connecting the cross-beam 56 to the shelf beam 52, such as by engaging mating openings or apertures therein. In some embodiments, the pins 92 have an enlarged head 92A, an enlarged plug 92B and a narrower neck 92C therebetween. The head 92A is preferably sized so that it won't pass through the openings on the flanges of the shelf beam 52 and cross beam 56, and may have a planar top to aid a user in pressing or hammering it downwardly. The plug 92B may be generally cylindrical or conical, and have an outer diameter which is slightly larger than the largest of the openings through the flanges of the shelf beam 52 and the cross beam 56, so as to generally resist removal therefrom once inserted therethrough. The neck 92C is preferably sized to fit through the openings. In some embodiments, the pin 92 (or at least the plug 92B portion thereof) may be constructed of rubber or other very durable, but slightly flexible, material. This, among other things, allow the plug 92B portion to deform and be pressed through the openings and then return to size.

Once a user has aligned a cross beam 56 with front and rear shelf beams 52, the user may press the pins 92 through the aligned openings in the flanges of the shelf beams 52 and the openings in the cross beams 56, locking them together. This can advantageously be done without the need for tools, such as wrenches or the like.

Another aspect of the invention is an improved method and configuration for packing the rack 20, preferably in a disassembled form, such as for shipping, storage and the like. In one embodiment, benefits of the invention are realized from the configuration of the features of the rack 20 as described above, such as which enable the size of the unassembled rack 20 to be reduced for packing.

Figure 13A:
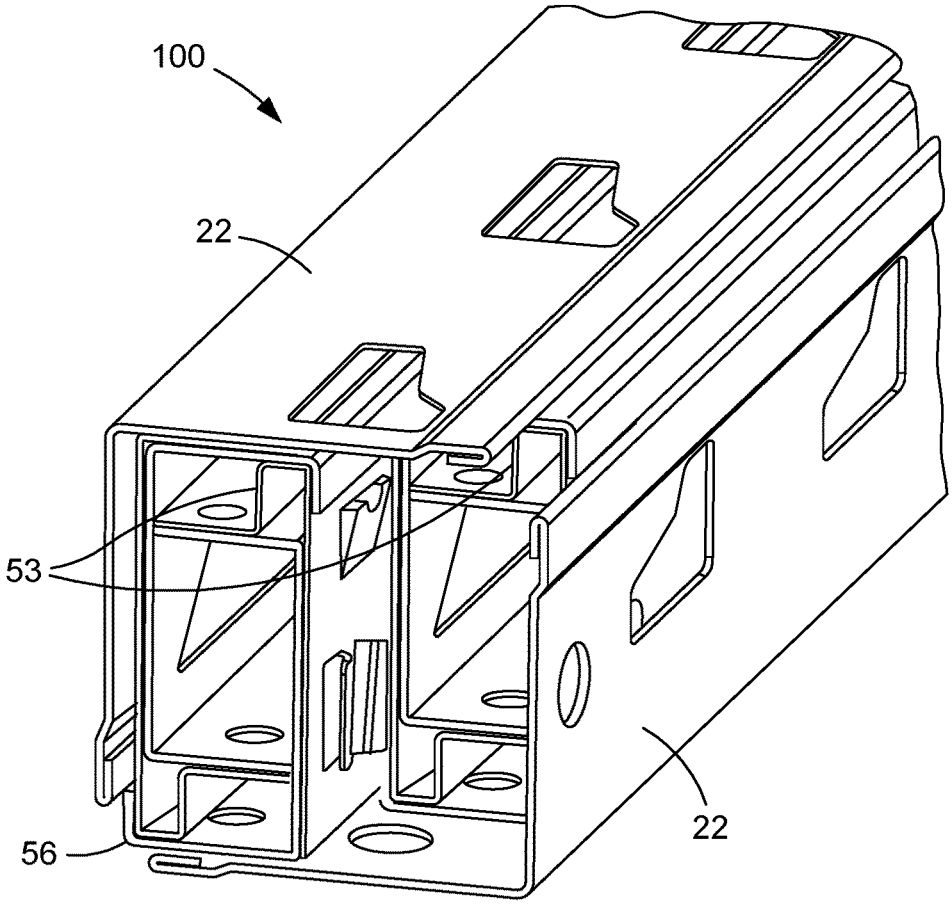
FIGS. 13A and 13B show isometric and front views, respectively, of an assembly set, in accordance with another non-limiting embodiment of the disclosed concept.
Figure 13B:
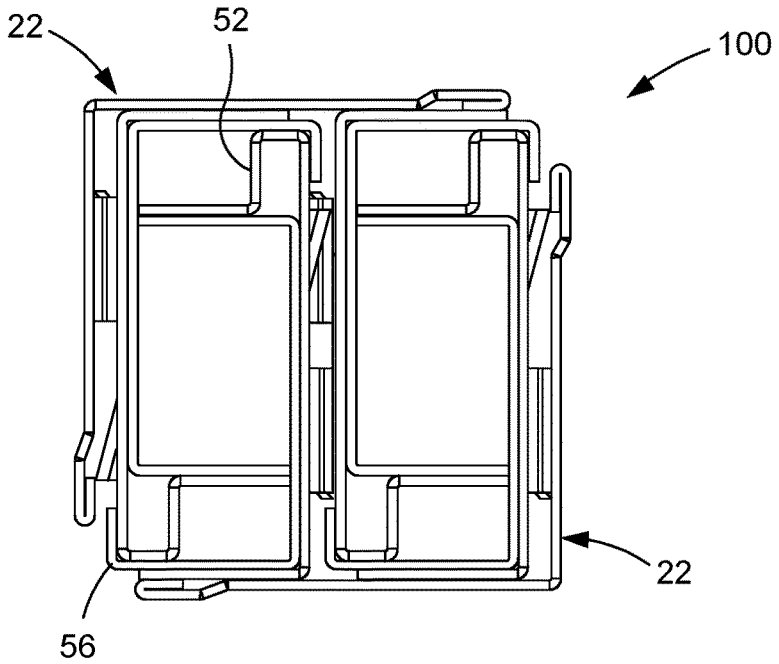
Figure 13C:
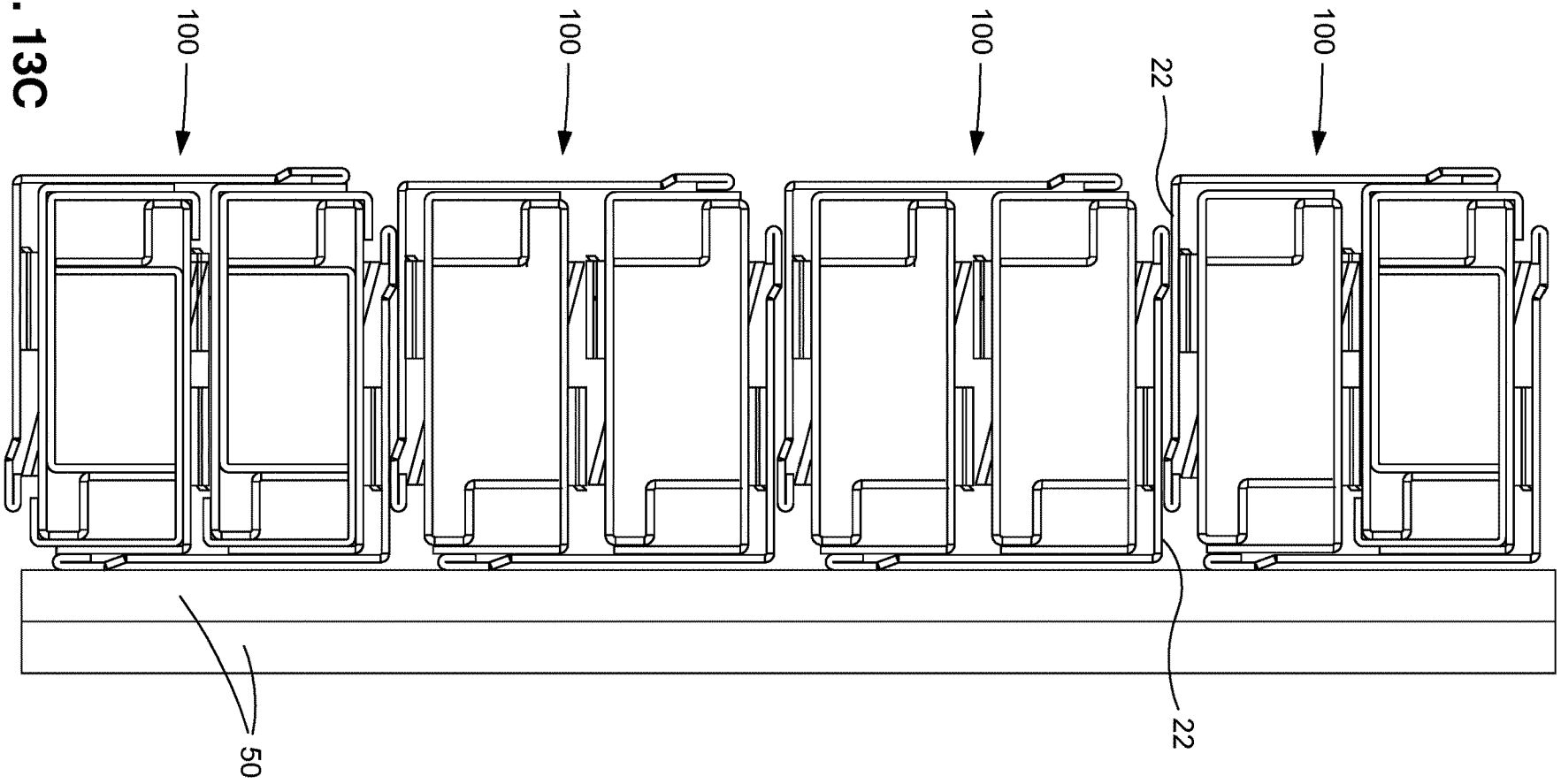
FIG. 13C shows a packaging kit including a plurality of the assembly sets of FIGS. 13A and 13B.

As one example, as illustrated in FIGS. 13A-13C, a configuration of the shelf beams 52 and the cross-beams 56 allows them to be nested for packing. FIGS. 13A and 13B illustrate an assembly set 100 that includes multiple cross-beams 56 and shelf beams 52 that nested within one another, and a pair of upright supports 22 each positioned such that the nested sets of cross-beams 56 and shelf beams 52 are nested or fit within the pair of upright supports 22. Additionally, FIG. 13C shows a packaging kit 200 for assembly into at least one storage rack (e.g., storage rack 20, shown in FIG. 1A). The packaging kit 200 includes a plurality of the assembly sets 100 (FIGS. 13A and 13B), and the plurality of assembly sets 100 are positioned side by side such that one of the pair of upright supports 22 of a first of the plurality of assembly sets 100 engages one of the pair of upright supports 22 of a second of the plurality of assembly sets 100. Additionally, in one example, the packaging kit 200 may include a plurality of decking members 50 (shown in simplified form in FIG. 13C in an end view as stacked) configured for placement on top of or below each of the plurality of assembly sets 100.

As illustrated, the shelf and end beams 52,54, cross-beams 56 and upright supports 22 are configured to be nested and layered, fitting inside and over one another, in a manner which minimizes the volume occupied thereby. The overall length of the unassembled and packed configuration of the rack 20 is also minimized by having the upright supports 22 be modular in form. The decking 50 may be configured to be located over the nested and layered beams and supports. In this manner, the size of packaging necessary for the unassembled rack 20 is minimized, thus reducing shipping and storage space and cost. In this respect, one aspect of the invention is a method for packing or packaging the elements of a rack 20 as described, including nesting the components thereof in the manner illustrated in FIGS. 13A and B, and then associating these assemblies with decking, such as in a stacked relationship. That entire assembly might then be placed in a box for shipping.

At the same time, as described above, the rack 20 and features thereof are configured to allow a user to easily assemble the rack 20. Further, the assembled rack 20 is configured to be strong and durable, such as reducing sway, disconnection of components and the like.

It will be appreciated that while various features of different components of the rack 20 have been described relative to the rack 20, the components or features may be used relative to other devices, such as workbenches and the like.

It will be understood that the above described arrangements of apparatus and the method there from are merely illustrative of applications of the principles of this invention and many other embodiments and modifications may be made without departing from the spirit and scope of the invention as defined in the claims.

What is claimed is:

1. A storage rack comprising:

a plurality of L-shaped upright supports comprising a first upright support, a second upright support, a third upright support, and a fourth upright support, each L-shaped upright support comprising a first leg and a second leg meeting at a right angle and at least the first leg having an opening therein; and a shelf support supported by each of the plurality of upright supports, the shelf support comprising a shelf beam extending between the first and second upright supports, the shelf beam comprising:

a body configured to connect to said first leg of the first upright support, the body having an end defined by an outwardly disposed panel face, an inwardly disposed panel face, and an end face therebetween, a first tab extending outwardly from the outwardly disposed panel face and, and a second tab extending outwardly from the outwardly disposed panel face and disposed parallel to an axis of a corresponding L-shaped upright support such that the second tab is disposed at an angle of between 5 degrees and 20 degrees with respect to the first tab, the first tab and the second tab each extending outwardly from the outwardly disposed panel face and configured to extend into the opening of the first upright support and engage the first upright support at opposing sides of the opening and in a wedging fashion in order to detachably connect the shelf beam to the first upright support.

2. The storage rack according to claim 1, wherein the end of the body of the shelf beam is a first end, wherein the shelf beam further comprises a third tab and a fourth tab each extending outwardly from a second end of the body and configured to engage the second upright support at opposing sides of the opening of the second upright support in order to detachably connect the shelf beam to the second upright support.

3. The storage rack according to claim 1, wherein the shelf support further comprises an end beam extending between the first and third upright supports, wherein the end beam comprises a body, a third tab, and a fourth tab, wherein the third and fourth tabs each extend outwardly from an end of the body of the end beam and are configured to engage the first upright support at opposing sides of another opening of the first upright support in order to detachably connect the end beam to the first upright support.

4. The storage rack according to claim 3, wherein the third tab is disposed at an angle of between 5 degrees and 20 degrees with respect to the fourth tab, in order for the third and fourth tabs to engage the third upright support in a wedging fashion.

5. The storage rack according to claim 1, further comprising a sleeve having an L-shaped opening dimensioned to engage the interior of the right angle and an exterior of the right angle.

6. The storage rack according to claim 1, wherein the second tab is disposed farther from a midpoint of the body than the first tab.

7. The storage rack according to claim 1, wherein each opening has a proximal side disposed closer to a seam of the first leg and the second leg than a distal side of the opening, wherein the proximal side is parallel to the seam and the distal side is angled with respect to the proximal side.

8. The storage rack according to claim 7, where each opening has a first wider portion and a second narrower portion disposed beneath the first wider portion.

9. The storage rack according to claim 1, wherein each opening has a top, a bottom, and a first side, the first side extending parallel to a length of the first upright support from the top to said bottom of the opening and a second side which has at least one portion angled relative to the first side.

10. The storage rack according to claim 8, wherein the second tab is oriented perpendicular to a length of the shelf beam and wherein the first tab is angled relative to the second tab.

* * * * *